United States Patent [19]

Van Loghem et al.

[11] 4,400,925

[45] Aug. 30, 1983

[54] BUILDING CONSTRUCTIONS

[76] Inventors: Johannes J. Van Loghem; Johannes La Grouw, both of Russell Rd., Rotorua, New Zealand

[21] Appl. No.: 316,069

[22] Filed: Oct. 28, 1981

Related U.S. Application Data

[63] Continuation of Ser. No. 85,210, Oct. 16, 1979, abandoned, which is a continuation of Ser. No. 927,333, Jul. 24, 1978, abandoned.

[30] Foreign Application Priority Data

May 23, 1978 [NZ] New Zealand ..... 187344

[51] Int. Cl.[3] ..... E04B 2/30; E04D 1/36

[52] U.S. Cl. ..... 52/471; 52/309.11; 52/479; 52/586; 52/779; 52/282

[58] Field of Search ..... 52/479, 586, 779, 562, 52/426, 471, 309.11, 282; 49/DIG. 1

[56] References Cited

U.S. PATENT DOCUMENTS

| | | | |
|---|---|---|---|
| 3,129,531 | 4/1964 | Connor | 52/426 |
| 3,416,275 | 12/1968 | Van Loghem et al. | 52/471 |
| 3,688,460 | 9/1972 | Van Loghem et al. | 52/471 |
| 3,837,132 | 9/1974 | Weller | 52/479 |
| 3,916,503 | 11/1975 | Chenevert | 49/DIG. 1 |
| 4,020,611 | 5/1977 | Amos | 49/DIG. 1 |

FOREIGN PATENT DOCUMENTS

| | | | |
|---|---|---|---|
| 2527841 | 1/1977 | Fed. Rep. of Germany | 49/DIG. 1 |
| 7600672 | 1/1976 | Netherlands | 52/426 |

*Primary Examiner*—John E. Murtagh
*Assistant Examiner*—Richard E. Chilcot, Jr.
*Attorney, Agent, or Firm*—Holman & Stern

[57] ABSTRACT

Joining planks to form a wall construction. Each plank has a wooden facing member on each side and there is insulation between the facing member and in each facing member there are jointing surfaces facing away from a surface of the facing member and to this surface another plank is joined and metal connecting members are inserted with connecting arms which are in contact with the jointing surfaces of the contacting facing members of contiguous planks. There is no metallic contact across the joined planks between the connecting members which have arms in contact with the jointing surfaces of the parallel facing members of the planks which are to be joined.

3 Claims, 4 Drawing Figures

BUILDING CONSTRUCTIONS

This is a continuation of application Ser. No. 085,210, filed Oct. 16, 1979 which in turn is a continuation of application Ser. No. 927,333, filed July 24, 1978 now both abandoned.

BRIEF SUMMARY OF THE INVENTION

This invention relates to building constructions.

It is an object of the present invention to provide a building construction which will at least provide the public with a useful choice.

Accordingly in one aspect the invention is in a method of joining planks to form a wall construction using planks, each plank having a wooden facing member on each side and insulation between said facing member and having in each wooden facing member jointing surfaces facing away from a surface of said facing member to which surface another plank is to be joined, by inserting metal connecting members having connecting arms in contact with jointing surfaces of contacting facing members of contiguous planks without metallic contact across the joined planks between said connecting members having arms in contact with jointing surfaces of parallel facing members of the planks being joined.

In a further aspect of the invention is a wall construction comprising a plurality of planks each plank having a wooden facing member on each side and insulation between said facing member and having in each wooden facing member jointing surfaces facing away from a surface of said facing member to which another plank is to be joined and a plurality of metal connecting members having connecting arms, said connecting members being inserted with connecting arms thereof in contact with jointing surfaces of contiguous facing members of said plank but without metallic contact across the joined planks between connecting members having arms in contact with jointing surfaces of parallel facing members of the planks being joined.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE SEVERAL VIEWS OF THE DRAWINGS

One preferred form of the invention will now be described with reference to the accompanying drawings in which.

DETAILED DESCRIPTION

Figure 1:
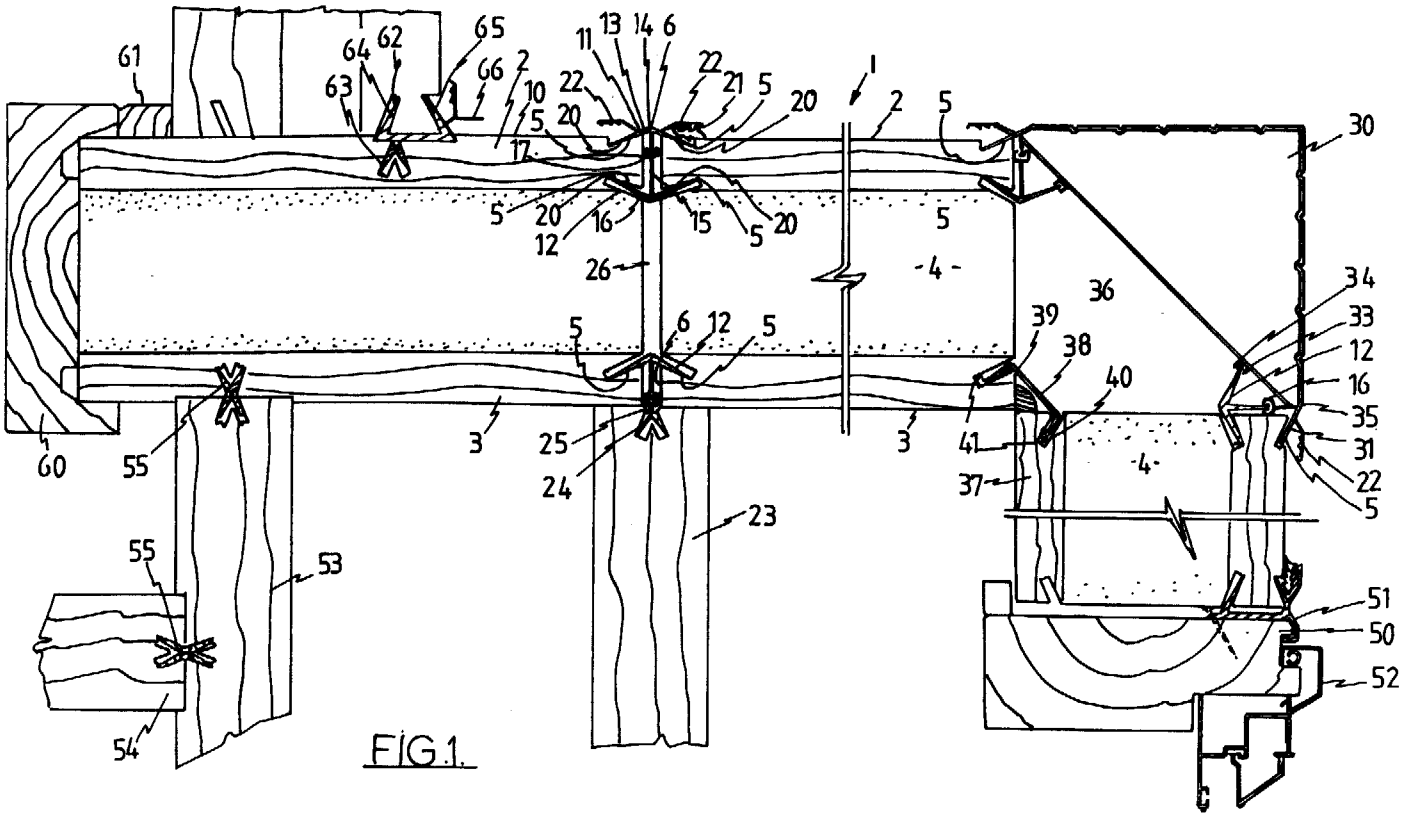
FIG. 1 is a cross section in plan of a building construction according to the invention.

Referring to FIG. 1 of the drawings a plurality of planks are assembled with connecting means to form a wall construction and the walls are assembled to form a building construction as described below.

The planks such as the plank 1 preferably comprises wooden face members 2 and 3 between which is an insulating core 4, the core 1 being, for example, formed by an in situ foam product such as foamed urethane.

The ends of the wooden face members 2 & 3 are provided with jointing surfaces 5 such as dovetail faces which face away from the end faces 6, such faces 5 being formed by routing or cutting with a suitably shaped dado head or saw or otherwise as desired. The present invention is particularly concerned with joining two longitudinally adjacent planks such as plank 1 to plank 10 and to this end connecting means are provided comprising two connecting members 11 and 12, the connecting member 11 having a central column 13 with a T-head 14 and the connecting member 12 having a control column 15 and a C-head having hooked arms 17 arranged as shown to hold the T-head 14 of the member 11. In addition, those members 11 and 12 have connecting arms with faces 20 which engage faces 5 of the planks. In addition, a seal 21 is arranged to be held in place by a suitable member 22, in particular where the outer face of timber member 2 of a plank is on the exterior of the building being constructed.

Where a partition plank 23 is to coincide with a junction between two planks such as the planks 1 and 10 the member 12 engages the member 24 having a T-head 25 similar to the T-head 14 of member 11. It will be noted that this construction has the particular advantage that there is an air gap 26 between the members 12 on either side of the planks 1 and 10, i.e. there is no metallic contact across the joined planks 1 and 10, thus assisting insulation and preventing direct transmission of heat through the connecting member.

The connecting members 11 and 12 may be of any suitable metal and are preferably extruded from aluminium alloy.

At corners of the building construction, columns 30 are provided with arms 31 having faces engaging the plank faces 5 and sealing holding members 22 as above described. Members 12 have one arm 33 fitting in a groove 34 in the column and with the C-head 16 engaging a T-head 35 of the column. On the inner face of the junction between the planks 1 and 37 a piece of quarter-round 38 is fitted to close any gaps between adjoining planks and a connecting member 39 is retained in grooves 40, the connecting members 39 having feet 41 to maintain a tight fit in the grooves 40. Again, there is an air space 36 between the column 30 and the joining member 39.

Generally joinery is readily catered for, for example, a window jamb 50 is mounted using a connecting means 51 connected to the plank 37 in a similar manner to that described above and the jamb is provided with an aluminium extrusion joinery section 52 substantially as shown. Connections between internal partitions 53 and 54 are provided by X-members such as 55 such as described in our U.S. Pat. No. 3,416,275. Ends of planks are covered for example with a capping member 60 and T-junctions can be provided either by using a cover batten 61 on one side and a connecting member 62 connected to a V-member 63 with "T" and "C" junctions 64 as shown. The outer member 65 is provided with seal holding members 66.

Figure 2:
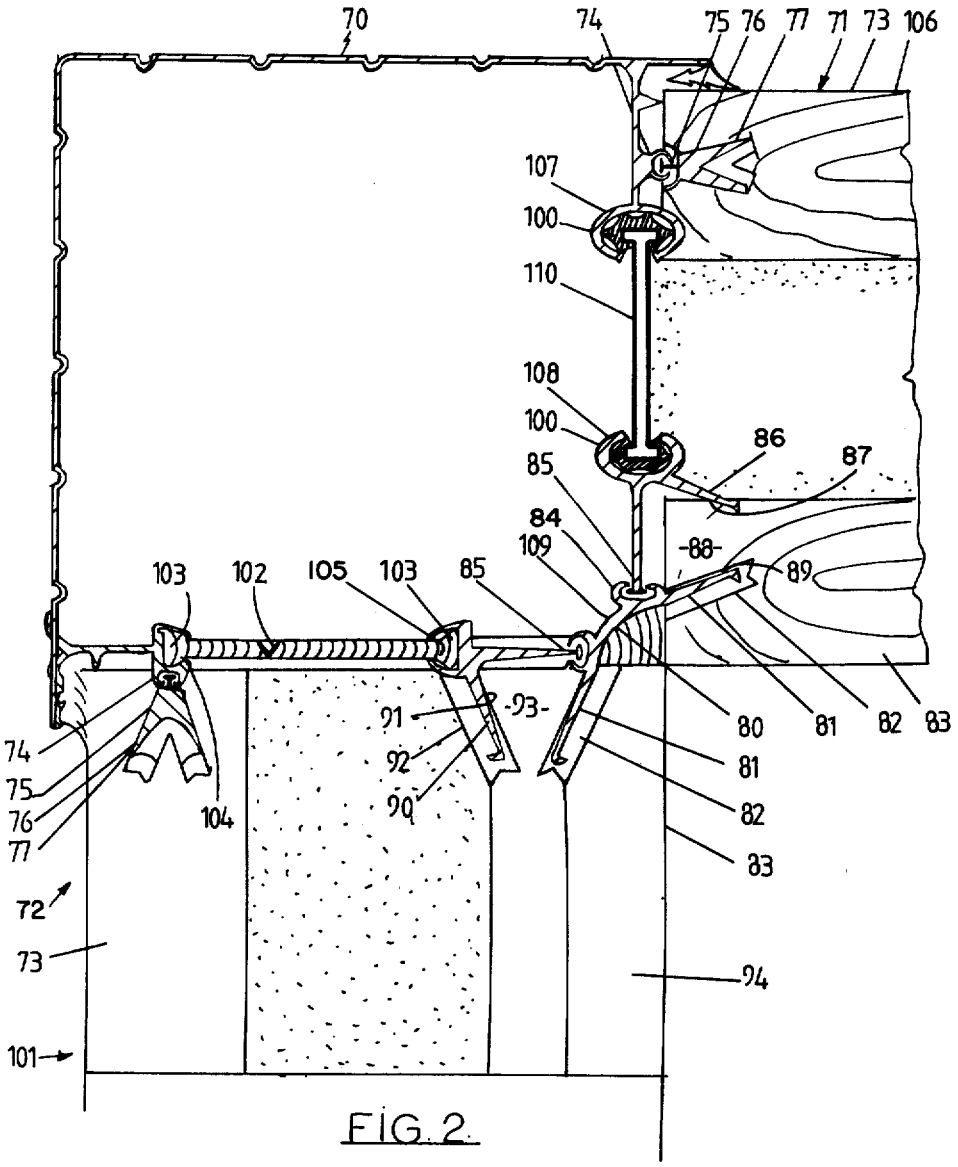
FIG. 2 is a plan view of a modified building construction according to the invention.

In FIG. 2 there are shown modified forms of connecting means. Thus a column 70 corresponding to the column 30 is arranged at the corner of two walls 71 and 72. The outer wooden faces 73 of these two members are connected to the column by the column having C sections 74 and a T member 75 connected to a V member 76 is inserted lengthwise into the C member 74 and the arms of the V member 76 engage faces 77. On the inner corner a connecting member 80 has arms 81 extending so as to fit in grooves 82 in the wooden face members 83. The member 80 has C members 84 in which T members 85 engage. An additional arm 86 is provided engaging a surface 87 so that a dove tail 88 is formed between surface 87 and surface 89. Similarly an arm 90 engages a surface 91 in a groove 92 so that a dove tail 93 is provided in the face 94. So that there is no metallic contact across the faces 73 and 83 two alternative constructions are shown in FIG. 2. Thus, across the plank 101 a thermal barrier member or link 102 is provided having dove tail ends 103 engaging in dove tail grooves 104 and 105. The thermal barrier member 102 is made of a suitable thermally insulating material, for example, an injection moulding of a plastic material such as polyvinylchloride or any other suitable material. Across the plank 106 the column 70 has a C termination 107 and a further C termination 108 is provided in association with the corner member 109 and the C members 107 and 108 are interconnected by a member 110.

Figure 3:
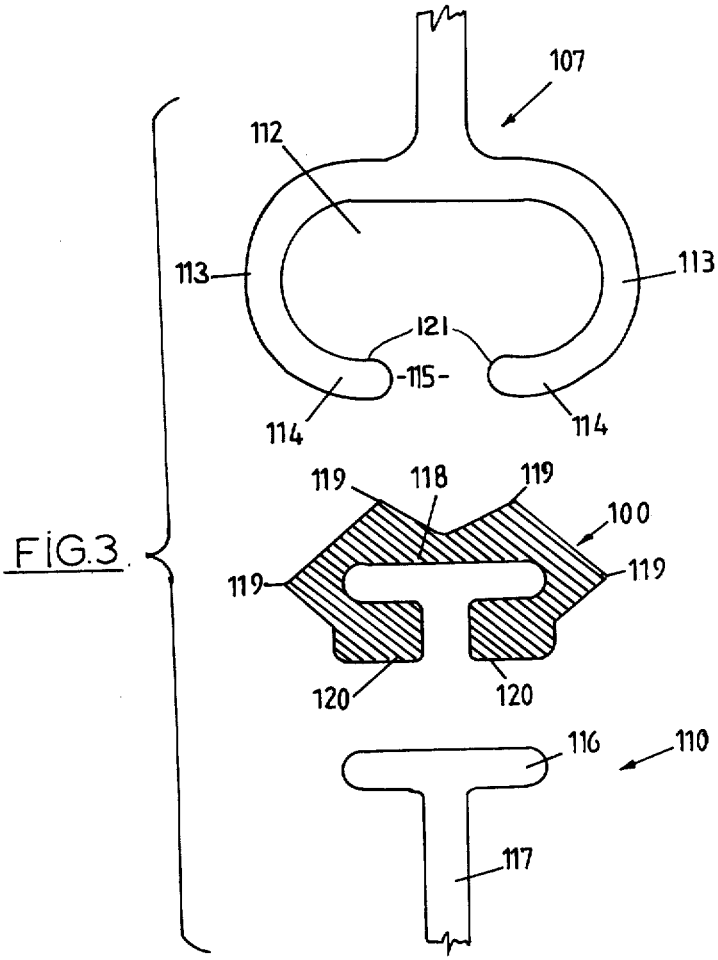
FIG. 3 is an enlarged exploded view of one type of connecting means according to the invention.

Referring now to FIG. 3 which is an exploded enlargement of the members 107 and 110 the member 107 has a channel 112 integrally extruded with the building hardware, the channel having flanges 113 incorporating shoulders formed by inwardly turned ends 114 having an opening 115 therebetween. The second part incorporates a T shaped flange 116 on the end of the web portion 117 forming an integral part of the member 110 and the width of the T shaped flange 116 is greater than the width of the opening 115 between the inwardly turned ends 114 of the channel flanges 113.

An infill 100 of heat insulating material is provided and preferably the infill 100 is formed from a plastics material such as a hard P.V.C. material. The infill 100 may be formed to a cross section having an inner profile the same as the profile of the T shaped flange 116 and an outer profile which fits within the inner profile of the channel 112. The infill preferably has an internal cross section 118 the same as the cross section of the T shaped flange 116 and an outer profile having ribs 119 arranged to contact the inner profile of the channel 112. The inner profile is provided with larger bearing areas 120 adapted to contact the inner faces 121 of the inwardly turned ends 114 of the flanges 113 of the channel 112 to provide a larger load bearing area as will be described further. The surfaces 120 are distorted somewhat when inserted in the channel 112.

In use the connector is assembled by slidably engaging the infill 100 within the channel 112 in the first part and then slidably engaging the T shaped flange 116 of the second part within the profile 118 in the infill. In this manner a link as shown at FIG. 2 is provided for the building hardware. The link 110 may be of metal or a plastics material, the selection depending on whether greater strength or greater insulation is required.

Figure 4:
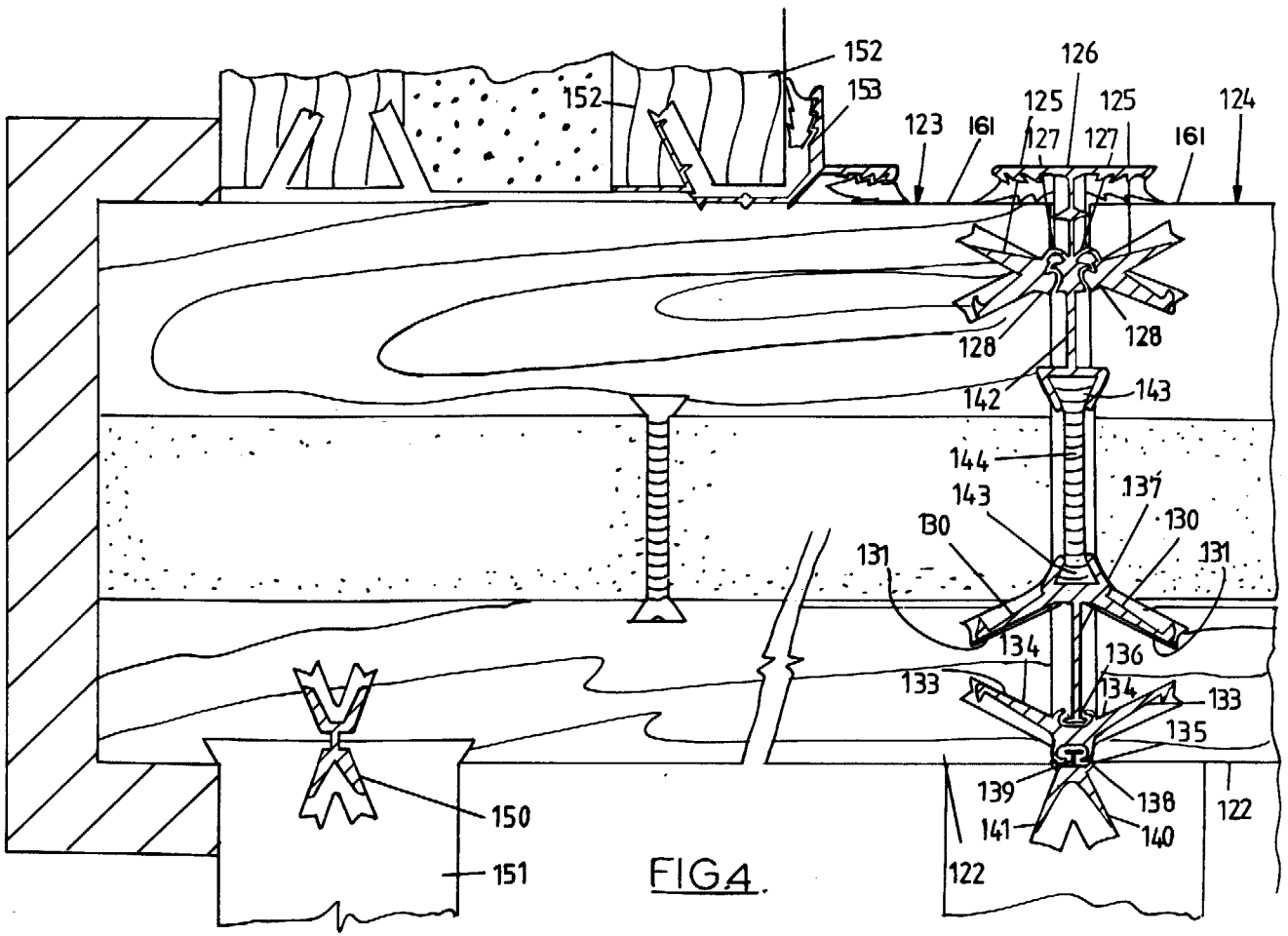
FIG. 4 is a plan view of a further modified building construction according to the invention.

In FIG. 4 there are shown further alternative arrangements. Thus the wooden faces 161 and 122 of planks 123 and 124 are interconnected, so far as face members 161 are concerned, by the members 125 connected to each other by an intermediate member 126 having C members 127 in which T members 128 fit as above described. The face members 122 are held together by arms 130 engaging faces 131 in slots in the face members 122 and similar arm members 133 engaging faces 134 and being interconnected by a member 135 connected by a T member 136 to a further member 137. A C channel 138 is engaged by T member 139 holding a V member 140 having faces in contact with faces of slot 141. The members 137 and member 142 are held to each other by dove tail members 143 between which is provided a non metallic e.g. plastics member 144. In this drawing there is also shown an X member 150 joining a thinner partition member 151 to a face member 122 and an insulated plank 152 joined to the face member 121 by a member 153.

The constructions above described are assembled in a similar manner to that described in our earlier U.S. Pat. No. 3,416,275 and only short connecting members may be used to save the work in having to raise planks to the top of a building line before being moved to their appropriate positions. However, at least in the preferred form the invention has the major advantages that particularly though not solely where insulated planks are used as has been described above, the spaces 26 and 36 provide air gaps between inner and outer connecting means or the links 102(& 110 if of plastics) or infill 100 provide insulation to reduce heat transmission through such spaces on members. If there were metallic connections across the joints between adjacent planks very high heat losses would occur and the invention reduces such heat losses to reasonably acceptable proportions.

The link shown in FIG. 2 has the feature that a sound structural connection is provided between the first and second parts of the connector and because the infill 100 is provided with solid load bearing surfaces 120 the link is able to take a substantial tension load. Even in an ultimate failure situation where the load applied to the link is such that the infill is completely deformed or destroyed the link will maintain structural integrity as the T shaped flange 116 cannot be withdrawn from the channel 112 as the width of the T shaped flange is greater than the width of the opening 115 between the flanges of the channel. The link 102 also avoids metallic contact from outer to inner wall faces giving acceptable thermal characteristics.

Thus the constructions according to the invention impede the passage of heat through plank connectors by providing breaks in the high conductivity metal connectors.

Although the heat insulating link 102 and infill 100 have been described for incorporating in a building plank or panel connector it will be apparent that such a link may be readily incorporated in any form of metal building hardware and particularly with extruded aluminium building hardware such as window or door joinery. This feature is particularly desirable in buildings formed from insulated building panels as otherwise a high proportion of the total heat lost from the building can take place through metal connectors between the panels and through other metal hardware or joinery in the building.

The links 110 and 102 have the major advantage of holding the timber boards on either side of the planks so that considerable forces in tension are resisted. Timber is a material which absorbs moisture and as a result its shape alters over a period of time and unless restrained, warping, bowing, or twisting of the boards relative to each other occurs. The invention at least assists in restricting such alterations in shape.

What is claimed is:

1. A wall construction comprising a plurality in planks joined at their ends to other members of the wall construction, each plank having a wooden facing member on each side and insulation between said facing members, each wooden facing member having adjacent the joined end thereof at least one jointing surface which is cut out substantially flat and extends in a plane intersecting at an acute angle with the end surface of said plank to be joined to another member of said wall construction, said planes of said jointing surfaces extending at an angle with respect to each other, a plurality of metal connecting members each comprising a shank portion having connecting arms extending in substantially opposite directions with respect to said shank portion and at an angle with respect to each other substantially the same as said angle of said planes of the jointing surfaces with respect to each other, said connecting members being inserted between said members to be joined and said connecting arms having surfaces extending in contiguous abutting relationship with said jointing surfaces of said facing members to retain said members together, and non-metallic tension resistant members made of heat insulating material interconnecting said shank portions of adjacent connecting members in opposite facing members of said joined planks, the interconnection between said connecting members and said tension resistant members comprising bulbous ends on said tension resistant members engaging within substantially C-shaped terminations on said shank portions.

2. A wall construction as claimed in claim 1 wherein pairs of connecting members are provided for the facing members at each joined end thereof and are interconnected by said tension resistant members so that said shank and tension resistant members are disposed between said joined ends.

3. A wall construction as claimed in claim 1 wherein said tension resistant members are connected to said connecting members by heat insulating members disposed within said C-shaped terminations between said bulbous ends and inner surfaces of said C-shaped terminations.

* * * * *